US005467507A

United States Patent [19]

Marsh et al.

[11] Patent Number: 5,467,507

[45] Date of Patent: Nov. 21, 1995

[54] POLYMER CABLE CHECK STRAP

[75] Inventors: David J. Marsh, Royal Oak; Gary L. Schubring, New Baltimore, both of Mich.

[73] Assignee: Emhart Inc., Newark, Del.

[21] Appl. No.: 123,310

[22] Filed: Sep. 17, 1993

[51] Int. Cl.[6] ..... A44B 21/00; E05F 5/00

[52] U.S. Cl. ..... 24/298; 24/300

[58] Field of Search ..... 24/298, 300, 302

[56] References Cited

U.S. PATENT DOCUMENTS

| | | | |
|---|---|---|---|
| 3,174,787 | 3/1965 | Kolman | 24/300 |
| 3,644,866 | 2/1972 | Deardurff | 174/130 |
| 3,657,774 | 4/1972 | Reynolds | 24/298 |
| 3,843,829 | 10/1974 | Bridges et al. | 174/36 |
| 4,398,317 | 8/1983 | Schubring | 24/302 |
| 4,534,163 | 8/1985 | Schuerch | 57/233 |
| 4,559,677 | 12/1985 | Tracy | 24/300 |
| 5,062,184 | 11/1991 | Rowland | 24/300 |
| 5,237,635 | 8/1993 | Lai | 174/110 |

*Primary Examiner*—Victor N. Sakran
*Attorney, Agent, or Firm*—Edward D. Murphy

[57] ABSTRACT

An integral strap assembly comprising a pair of end fasteners molded onto the ends of a nylon cable. The cable is made up of a round bundle of small individual extruded nylon strands enclosed in a sheath of braided nylon. The strap assembly is preferably used to check the motion of automobile glove box doors, station wagon tailgates, and the like.

7 Claims, 1 Drawing Sheet

POLYMER CABLE CHECK STRAP

REFERENCE TO RELATED PATENT

This invention is an improvement on the invention of prior U.S. Pat. No. 4,398,317 entitled CHECK STRAP by inventor Gary Leland Schubring herein. The present invention and the prior patent are commonly owned. The teachings of this prior '317 patent, to the extent required, are incorporated by reference herein, as if here set forth in full.

BACKGROUND OF THE INVENTION

The present invention relates to a checking device, and more particularly to an integral strap assembly comprising a pair of fasteners molded onto the ends of a polymer cable which may be employed to limit travel between two movable parts.

In the design and assembly procedures of various mechanical components, there is often a need to provide a checking device for maintaining two movable parts at a predetermined distance from each other during use of the two parts. This is particularly true in the case of a hinged door which is to be maintained in a particular orientation when fully opened and as to which a greater degree of movement would be undesirable. A device such as the tailgate of a station wagon or an automobile glove box door are typical examples wherein it is desirable to maintain the door in a substantially horizontal position when it is fully opened and to prevent it from swinging below that position.

Various arrangements have been employed in the past to meet the requirements set forth above. However, many such prior methods and structure have generally required the use of screws, rivets and other fastening means to retain the checking device on the structure. Generally, the assembly techniques required to install these devices have needed a plurality of parts which are expensive to maintain in inventory and require a considerable amount of labor to install.

In the case of an automobile glove box door which is subjected to a large number of cycles of opening and closing during the life of the automobile, repairs or service to the structure, requiring removal of the check device, are time consuming and usually result in damage to the related components. In addition, in the instance where a single strap is employed to check the glove box door relative to the assembly, the minimum number of separate parts necessary in inventory for replacement or service is three; a single cord and two threaded fasteners, the threaded fasteners often needing to be replaced with larger fasteners due to the damage to the structure in removing the fasteners therefrom. Thus, a plurality of fasteners and cords is necessary to provide this type of checking arrangement, even though attempts are made to keep the particular parts to a minimum.

It is therefore an object of the present invention to provide a check strap for limiting travel between two movable parts which is inexpensive, simple to manufacture, and easy to install and remove without damage to related parts.

A further object of the invention is to provide an article of manufacture which comprises an integral strap assembly comprising a pair of fasteners molded onto the ends of a polymer cable having the drive pins integrally connected to the fastener ends during molding thereof resulting in a one piece article to be maintained in inventory for initial installation, as well as for replacement or service requirements.

Another object of the present invention is to solve the problem of creep caused by the "memory" of solid plastic cords when they are stored in a curled position. The problem that occurs is that such a curled solid plastic cord, due to the "memory" of the plastic used, typically nylon, resists opening, and consequently remains in a partially curled position when opened. This results in the glove box door or tailgate not opening properly under the control of such prior art straps.

The present invention solves this problem in that the polymer cable of the invention does not have this type of "memory" and does not suffer from this kind of plastic creep. And, in addition to not having this problem, the polymer cable of the invention is stronger than the solid nylon cord of the prior art.

SUMMARY AND ADVANTAGES OF THE INVENTION

The above objects, and other objects which will become apparent as the description proceeds, are accomplished by providing a strap comprising a pair of bosses connected by a polymer cable wherein each of said bosses has a cylindrical bore formed therethrough to provide a relatively thin wall. The cylindrical bore of each boss has a tapered portion extending toward one end of the boss to provide a minimum bore dimension near the one end. A cylindrical drive pin comprising a cylindrical shank is inserted into the bore of the boss with the boss placed in an opening in the structure. The opening in the structure is such that the boss expands with the drive pin inserted therein due to the minimum bore dimension. A flange is provided at the end of the boss into which the drive pin is inserted and the drive pin is provided with a head having a surface mating with the flange when the drive pin is fully inserted into the bore of the boss. Both the surface of the drive pin head and the flange are provided with a chamfer which when juxtaposed one with the other forms a groove for insertion of a tool to pry the pin from the boss for easy disassembly.

The strap also may include an elongated member adjacent a boss and extending substantially parallel thereto, which is insertable into the structure when the boss is inserted, to prevent the boss from rotating and therefore maintain the strap in alignment when the strap is assembled to the structure.

The improvement of the present invention resides primarily in the provision of a molded assembly, rather than the one-piece molded device of the prior '317 patent. In this manner, the end members can be made more rigid, and the "flexible link" of that prior patent is replaced by a polymer cable of a particular design described below. These changes result in the advantages that the flexible cable of this invention is stronger in tension and more flexible than is the molded nylon cord of the prior patent. Further, since the ends are formed separately by molding onto the cable, these ends can be formed of more rigid material than that used in the '317 patent, which is desirable for the purpose of increasing strength. Further, the polymer cable of the invention is more flexible in addition to being stronger than is the solid molded nylon cord of said prior '317 patent.

The cable of the invention is preferably formed of a relatively large number of relatively small diameter extruded strands of nylon arranged in a round bundle and enclosed in a braided nylon sheath or cover.

BRIEF DESCRIPTION OF THE FIGURES

The invention will be best understood when this specification is read in conjunction with the accompanying drawing also forming a part of this disclosure, and in which.

DESCRIPTION OF THE PREFERRED EMBODIMENT

Figure 1:
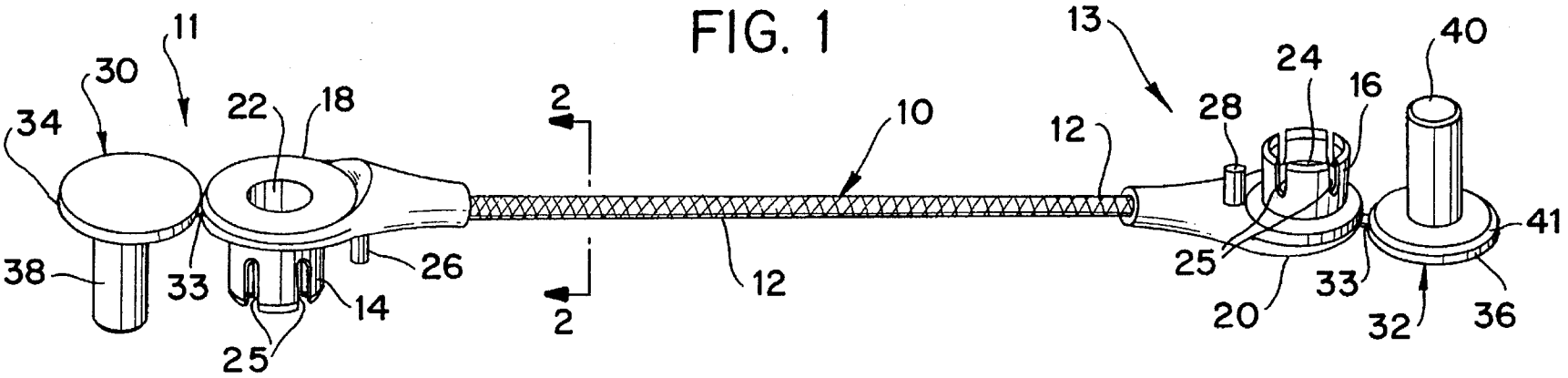
FIG. 1 is a perspective view showing a strap embodying the invention.

Referring to FIG. 1, there is shown an integral strap assembly 10 comprising a pair of fasteners 11 and 13 molded onto the ends of a polymer cable 12. The material preferable for use as cable 12 is nylon. The cable 12 is of circular configuration to thus be uniformly flexible in all directions. The end fasteners 11 and 13 include a pair of oppositely facing bosses 14 and 16, respectively.

Each of said bosses 14 and 16 has an outwardly projecting circular flange 18 and 20 respectively displaced at one end of a respective boss, to which the cable 12 is connected.

Each of the bosses 14 and 16 is further provided with a circular bore 22 and 24 respectively, extending through the respective boss. The outer diameter of the bosses 14 and 16 and the diameter of the bores 22 and 24 are of a magnitude to produce a relatively thin wall in each of the bosses. At the end of each of the bosses 14 and 16 opposite the respective flange 18 and 20 the bore 22 and 24 is tapered inwardly from about halfway through the bore length to the open end thereof. A plurality of slots 25 extend from the tapered end of the bore 22, 24 to approximately the point along the bore length at which the taper begins.

Adjacent each of the bosses 14 and 16 and extending from the point at which the respective flange 18 or 20 is connected to the cable 12, there is disposed an elongated member in the form of a cylindrical pin 26 and 28 of substantially smaller diameter than the bosses. These pins 26 and 28 are used to align strap 10 in use, as is described in the prior '317 patent which is incorporated herein by reference.

At the opposite side of the flanges 18 and 20 there is molded a drive pin 30 and 32 respectively, each of which is connected to its respective flange by a frangible tab 33. Each of the drive pins 30 and 32 comprises a circular head 34 and 36 respectively, and a cylindrical shank 38 and 40, respectively.

The drive pin 32 is provided with a chamfer 41 on the underside thereof and the flange 18 is provided with a similar chamfer at the edge thereof to form a groove when the parts are assembled. This groove facilitates disassembly of the strap from the structure by providing a place to insert a tool to pry the pin out of the boss. As with other features described above, the boss 18 and the boss 16 are of substantially identical construction as are the drive pins 30 and 32, and therefore it will be understood that the drive pin 32 and the flange 20 of the boss 16 also are provided with similar chamfers.

As shown in FIG. 1, and as can be seen most clearly when comparing this FIG. 1 to FIG. 1 of the '317 patent, the "necks" of the flanges 18 and 20 are thickened and enlarged where they attach to the ends of the cable 12. This improves the style and appearance of the resultant strap assembly 10, as well as increasing the strength of the fastener members 11 and 13.

The end fasteners 11 and 13 are separately molded onto the ends of the cable 12. If desired, these members 11 and 13 can be formed of different and preferably more rigid material than that of the polymer(s) used in the cable 12. The preferred material for these end members 11 and 13 is nylon.

Figure 2:
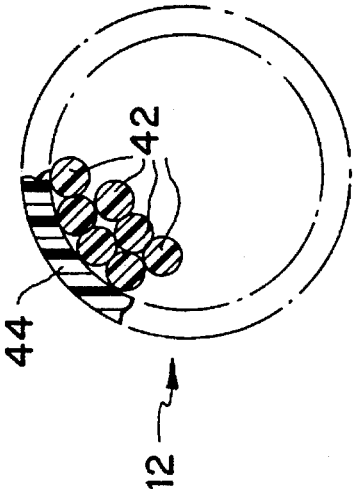
FIG. 2 is an enlarged cross-sectional view of the cable of the invention taken on line 2—2 of FIG. 1.

The cable 12 is shown in FIG. 2. It comprises a relatively large number of relatively small extruded polymer strands 42 arranged in a round bundle and encased in a braided polymer cover 44. Nylon is the preferred material for the strands 42 and cover 44. The strands 42 can be of round or other cross-sectional shapes.

While the end fasteners 11 and 13 and the strands 42 and cover 44 are all preferably made of nylon, these parts can be made from the same or different grades or types of nylon, as needed.

The manner of assembly, disassembly and use of the invention strap assembly 10 is shown, is apparent and is described in detail in the prior '317 patent. Reference as needed should be had to that patent which has been incorporated herein by reference.

While the invention has been described in detail herein, it is to .be understood that this detailed description is by way of example only, and the protection granted is to be limited only within the spirit of the invention and the scope of the following claims.

We claim:

1. A strap assembly for limiting the motion of a first, relatively moveable closure member with respect to a second member, while allowing free travel of said first member even after said first member has remained at one extremity of its motion for an extended period of time, said strap assembly comprising:

a cable extending between said first and said second members;

said cable comprising a plurality of single strands of plastic material and a sheath of braided plastic enclosing said plurality of strands;

said plurality of strands and said braid together allowing said cable to readily convert from curled to straight and from straight to curled orientations upon corresponding relative movement of said first and said second members to enable said first member to readily move between fully open and closed positions without being affected by the time for which it has remained in either position; and an end fastener molded on each end of said cable, each of said fasteners comprising:

a cylindrical portion molded over an end of said cable;

a flange portion extending from said cylindrical portion and a boss extending from said flange engagable with one of said first and said second members.

2. The strap assembly of claim 1, wherein said cable comprises a relatively large number of extruded nylon strands arranged in a round bundle and encased in a sheath of braided nylon.

3. The strap assembly of claim 1, wherein said end fasteners are formed of nylon.

4. The strap assembly of claim 1, wherein said first member and said second member comprise an automobile's glove box door and the associated glove box frame structure.

5. The strap assembly of claim 4, wherein said cable is flexible in all directions about its center line, each of said bosses having a circular bore formed therethrough to provide a relatively thin wall, each said circular bore having an inwardly tapered portion extending toward the end of said bore opposite said end at which said flange is disposed to provide a minimum dimension of said bore near said opposite bore end, a pair of cylindrical drive pins each comprising a cylindrical shank for insertion into a said bore and a circular head at one end thereof each connected to a respective circular flange of a said boss by a frangible portion, a plurality of slots formed in said thin wall and extending from said opposite bore end over substantially the length of said tapered portion of each said boss and a pair of elongated members one extending from said strap adjacent each of said bosses and substantially parallel thereto, whereby with one boss and its adjacent elongated member received in a respective pair of spaced openings in said door and the other said boss and its adjacent elongated member received in a respective pair of spaced openings in said glove box structure, said cylindrical drive pins after being separated at said frangible portions are assembled with each said pin shank inserted into a respective boss bore causing said boss bore to expand and retain said boss in its respective opening with said elongated member inhibiting rotation of said boss.

6. The strap assembly of claim 5, wherein each of said circular heads has a surface adjacent said shank for contacting a surface of said flange of said boss with said pin inserted in said boss bore, and said flange surface and said head surface each has a chamfer formed at the edge thereof in opposed relation to form a groove between said contacting surfaces to facilitate separation of said drive pin from said boss by prying action.

7. The strap assembly of claim 1, wherein said first member and said second member comprise an automotive tailgate door and the associated portions of the frame of the automotive vehicle.

* * * * *